United States Patent [19]

Arisaka et al.

[11] 4,008,301

[45] Feb. 15, 1977

[54] PROCESS FOR THE PRODUCTION OF NONWOVEN CELLULOSE ACETATE LAMINATE CURED WITH PHENOLIC RESIN

[75] Inventors: Katsuharu Arisaka, Sakai; Hideo Sawada, Osaka; Kozo Shimoguchi, Sakai, all of Japan

[73] Assignee: Daicel, Ltd., Osaka, Japan

[22] Filed: Jan. 22, 1975

[21] Appl. No.: 543,180

[30] Foreign Application Priority Data

Jan. 24, 1974 Japan ..... 49-10495

[52] U.S. Cl. ..... 264/137; 264/128

[51] Int. Cl.[2] ..... B29G 7/00

[58] Field of Search ..... 264/115, 83, 121, DIG. 70, 264/122, 128, 137

[56] References Cited

UNITED STATES PATENTS

| | | | |
|---|---|---|---|
| 2,152,901 | 4/1935 | Manning | 264/29 |
| 2,707,804 | 5/1955 | Thornburg | 264/83 |
| 3,436,304 | 4/1969 | Spence | 264/128 |
| 3,494,263 | 2/1970 | Tachibana et al. | 264/128 |

FOREIGN PATENTS OR APPLICATIONS

| | | | |
|---|---|---|---|
| 984,089 | 2/1965 | United Kingdom | 264/DIG. 75 |

*Primary Examiner*—Robert F. White
*Assistant Examiner*—James R. Hall
*Attorney, Agent, or Firm*—Woodhams, Blanchard and Flynn

[57] ABSTRACT

A nonwoven cellulose acetate laminate is made from a base material mainly composed of a cellulose acetate fiber web, in a short time, by the steps of: impregnating a liquid initial condensate of phenol-formaldehyde into the web or spraying a powdery condensate of phenol-formaldehyde onto the web, and then penetrating superheated steam through the resultant cellulose acetate laminate sheet. The sheet possesses good mechanical properties and excellent sound-absorbing and heat-insulating characteristics.

7 Claims, No Drawings

PROCESS FOR THE PRODUCTION OF NONWOVEN CELLULOSE ACETATE LAMINATE CURED WITH PHENOLIC RESIN

BACKGROUND OF THE INVENTION

1. FIELD OF THE INVENTION

This invention relates to a process for producing a nonwoven cellulose acetate laminate cured with a phenolic resin, which laminate possesses excellent mechanical properties, heat-insulating properties, and thermal resistance.

2. DESCRIPTION OF THE PRIOR ART

In recent years nonwoven cellulose acetate laminates have been used as sound-absorbing and heat-insulating materials which possess excellent sound-absorbing characteristics and heat-insulating properties, and which are well-balanced in mechanical performance and processability. There are, however, some difficulties in the process for manufacturing such laminates. For example, a heat-pressing step is necessary in the production process. Thus it is difficult to produce the laminates efficiently in a short time.

SUMMARY OF THE INVENTION

The primary object of this invention is to provide a relatively rapid and efficient process for producing a laminate that possesses excellent sound absorbing and heat-insulating properties, without any deterioration in its mechanical performance. We have discovered that a base or substrate material principally composed of a cellulose-acetate-fiber, nonwoven web can be impregnated with a liquid initial condensate of phenol-formaldehyde or sprayed with a powder condensate of phenol-formaldehyde, to form a laminate (mat layer) essentially consisting of the cellulose acetate web and the condensate. The laminate thereafter is cured and molded in a short time by penetrating therethrough superheated steam to form a laminated sheet having good mechanical properties and excellent sound-absorbing and heat-insulating characteristics.

In accordance with this invention, a nonwoven cellulose acetate fiber laminate, cured and molded with a condensate resin of phenols and aldehydes, is made efficiently from a base material consisting essentially of a nonwoven cellulose acetate fiber web, in a short time, by impregnating a liguid initial condensate of phenols and aldehydes into, or by spraying a powdered condensate of phenols and aldehydes onto, the web, and then penetrating superheated water vapor through the web.

The sheet possesses good mechanical properties and excellent sound-absorbing and heat-insulating characteristics.

DETAILED DESCRIPTION

The initial condensate of phenol-aldehyde employed in this invention is a novolak resin powder, or a liquid resol resin and it can be cured with heat or a conventional curing agent.

Methods of preparing resol and novolak resins are well known in the art. For example, phenol or substituted phenols such as cresol is subjected to condensation polymerization with an aldehyde such as formaldehyde at a molar ratio of aldehyde to phenol of 1.5 to 1, in the presence of a basic catalyst to produce a resol resin. A novolak resin is prepared by reacting phenol and aldehyde at a molar ratio of aldehyde to phenol of 0.8 to 1, preferably using an acid catalyst to produce a novolak resin powder. Although resols and novolaks of phenol and formaldehyde are most important, phenol derivatives and other lower aldehydes can be employed to make resols and novolaks.

The phenol-aldehyde condensate can be added to the cellulose acetate fibers before, during, or after the web-forming process. It is preferred to employ a liquid initial condensate mixed with a plasticizer which is applied by spraying it onto the fibers before forming the web or by spraying it onto the preformed web. It is more difficult to incorporate in the web a solid initial condensate, but it can be added in the pulverized state by spraying it or sprinkling it onto the web or the fibers. Moreover, a solution of the liquid initial condensate free of plasticizer, can be employed, if desired. The combined use of liquid condensate with a plasticizer reduces the viscosity of the initial condensate and improves its workability.

The amount of the initial condensate added to the fibers or web, according to this invention, can be varied within the range of 5 to 40 percent by weight, based on the total weight of the final web product.

The initial phenol-aldehyde condensate can be mixed with one or more plasticizers for cellulose acetate webs known in the art. Examples of suitable plasticizers are phthalic acid esters, such as dimethyl phthalate, dibutyl phthalate, and dioctyl phthalate; and fire retardant plasticizers of the phosphoric ester type, such as tris($\beta$-monochloroethyl) phosphate, tris(2,3-dichloropropyl) phosphate, and tris(2,3-dibromopropyl) phosphate. The mixing ratio of liquid initial condensate to plasticizer is in the range of 100 weight percent to 35 weight percent of said condensate and the balance (0 to 65 weight percent) is plasticizer, preferably 98 weight percent to 35 weight percent of condensate and the balance (2 to 65 weight percent) is plasticizer, although it is of course possible to use them in an arbitrarily different ratio for special purposes.

It is desirable that the plasticizer and the liquid initial condensate employed in this invention are added to and distributed in the cellulose acetate web as uniformly as possible by use of any conventional process. The addition process can comprise, for example, mixing the fibers, the plasticizer, and the initial condensate by means of an air stream after fibrillation of the fibers and then accumulating the coated fibers to form a nonwoven web or mat.

The nonwoven cellulose acetate laminate (mat layer) so produced, which contains the initial condensate and, if required, the plasticizer, is then heated for a short time, such as 2 to 3 minutes, by the passage of superheated steam therethrough. Normally, curing is effected while the laminate is confined so as simultaneously to be molded in a fixed shape. The phenol-formaldehyde resin is thus cured in a short time, and the article is produced in the form of a laminate of a given shape.

The superheated steam employed for curing the phenol-aldehyde condensate generally has a pressure in the range of 0.05 to 3.0 kg/cm$^2$ and a temperature in the range of 80° to 150° C. The steam is supplied at such a rate that no condensed water forms in the cellulose acetate laminate during the curing.

The materials used for preparing the cellulose acetate fibers used in this invention include conventional fiber-forming cellulose acetates. It is preferred to use an acetone-soluble cellulose acetate having an acetyl value of 36–41 percent. The cellulose acetate is formed into filaments by dry spinning according to conventional process, then the filaments are cut in a given length to form staple fibers, and then the staple fibers are shrunk. The thus-formed cellulose acetate staple fibers are employed to form the nonwoven cellulose acetate fiber mat.

The fiber content of the sound-absorbing and heat-insulating product of this invention consists mainly or principally (i.e. from 100 percent to 50 percent by weight) of cellulose acetate fibers. Up to 50 percent by weight of the total fiber content of the laminate product can consist of other fibers such as polyvinyl chloride, polyethylene glycol terephthalate, polyacrylonitrile, and the like, or mixtures thereof.

According to this invention, an excellent heat-insulating and sound-absorbing cellulose acetate fiber laminate cured with a phenolic resin is obtained. The product is superior in its mechanical characteristics, and it possesses a favorable balance of other desired properties, such as sound-absorbing and heat-insulating characteristics.

This product possessing the improved physical properties is suitable for use as a heat-insulating and sound-absorbing material in the construction of ceilings, doors, and walls, and it is also useful as a thermal or acoustical insulation for the motors or engines in ships, trains, or automobiles.

This invention is further described by reference to the following illustrative examples.

EXAMPLE 1

Thirty-five parts by weight of acetone-soluble cellulose acetate staple fiber having a denier of 4 and having a fiber length of 51 mm, 35 parts by weight of the same staple fiber having a denier of 8 and having a fiber length of 51 mm, and 30 parts by weight of polyacrylonitrile staple fiber having a denier of 10 and having a fiber length of 51 mm were fibrillated by use of a roller-card.

The resulting web was sprayed on its surface with 100 parts by weight of tris($\beta$-monochloroethyl) phosphate and 50 parts by weight of an initial liquid condensate of phenol-formaldehyde (manufactured by Showa Union Co. under the designation PE-400), per 100 parts by weight of said web, while the web was being wound on a winding drum.

Then, the uncured sheet (having a weight per unit area of about 500 g/m$^2$) thus produced, was passed through a continuous molding machine wherein it was confined by wire nets on its upper and lower sides and its thickness was reduced to 4 mm, at a rate of 0.4 m/min., while being penetrated by superheated steam having a pressure of 1.5 kg/cm$^2$ to form continuously a cured cellulose acetate fiber sheet.

The sheet thus produced was a nonwoven cellulose acetate fiber laminate, which had a density of 135 kg/m$^3$, a noticeable hardness and an excellent sound-absorbent property. It was superior in appearance, solvent resistance, and inflectional fatigue resistance. It was self-extinguishing when tested for its combustion properties by the method according to MVSS (U.S. automobile-interior furniture standard).

EXAMPLE 2

A web was produced by the same process using the same starting materials, as described in Example 1. It was placed in an iron mold provided with an outlet and inlet for steam at its ends. The web was penetrated by superheated steam having a pressure of 1.5 kg/cm$^2$ supplied from one end. After about two minutes, the product was taken out as a nonwoven cellulose acetate laminate which had been cured and molded to conform with the shape of the mold.

The resultant molded product had a density of 125 kg/m$^3$, it had a significant hardness, it was excellent in sound-absorbent properties, and superior in appearance, as well as solvent resistant and inflectional fatigue resistant. It was self-extinguishing when tested for combustion properties by the method according to MVSS.

The embodiments of the invention in which an exclusive property or privilege is claimed are defined as follows:

1. A process for manufacturing a molded article made of a non-woven cellulose acetate fiber web, which consists essentially of the steps of:

a. impregnating substantially uniformly a nonwoven web of fibers consisting essentially of from 50 to 100 weight percent of cellulose acetate fibers, the balance being another fiber selected from the group consisting of polyvinyl chloride fibers, polyethylene glycol terephthalate fibers, polyacrylonitrile fibers and mixtures thereof, with a liquid composition consisting of 35 to 100 weight percent of liquid resol resin, the balance being a plasticizer for cellulose acetate, said impregnated web containing from 5 to 40 weight percent of said liquid resol, based on the total weight of the impregnated web;

b. placing said web between molding surfaces defining a mold cavity;

c. pressing said web to conform same to the shape of said cavity;

d. injecting, simultaneously with step (c), superheated steam at a pressure of from 0.05 to 3.0 kg/cm$^2$ and a temperature of from 80° to 150° C through said web at a rate that is effective to prevent condensation of water in said web and for a period of time effective to cure said resol resin;

e. terminating the injection of said steam; and f. removing the cured cellulose acetate fiber web from said mold.

2. A process in accordance with claim 1 wherein said cellulose acetate fibers have an acetyl value of 38 to 41 percent and are soluble in acetone.

3. A process in accordance with claim 1 wherein the liquid composition consists of from 35 to 98 weight percent of said liquid resol resin and the balance is said plasticizer.

4. A process in accordance with claim 3 in which said plasticizer is selected from the group consisting of phthalic acid esters and fire retardant phosphoric esters.

5. A process in accordance with claim 4 in which said plasticizer is selected from the group consisting of dimethyl phthalate, dibutyl phthalate, dioctyl phthalate, tris($\beta$-monochloroethyl) phosphate, tris(2,3-dichloropropyl) phosphate and tris(2,3-dibromopropyl phosphate.

6. A process for manufacturing a molded article made of a non-woven cellulose acetate fiber web, which consists essentially of the steps of:

a. impregnating substantially uniformly a nonwoven web of fibers consisting essentially of from 50 to 100 weight percent of cellulose acetate fibers, the balance being another fiber selected from the group consisting of polyvinyl chloride fibers, polyethylene glycol terephthalate fibers, polyacrylonitrile fibers and mixtures thereof, with a powder of a novolak resin, said impregnated web containing from 5 to 40 weight percent of said novolak resin, based on the total weight of said impregnated web;

b. placing said web between molding surfaces defining a mold cavity;

c. pressing said web to conform same to the shape of said cavity;

d. injecting, simultaneously with step c., superheated steam at a pressure of from 0.05 to 3.0 kg/cm$^2$ and a temperature of from 80° to 150° C through said web at a rate that is effective to prevent condensation of water in said web and for a period of time effective to cure said novolak resin;

e. terminating the injection of said steam; and f. removing the cured cellulose acetate fiber web from said mold.

7. A process in accordance with claim 6 wherein said cellulose acetate fibers have an acetyl value of from 38 to 41 percent and are soluble in acetone.

* * * * *